US008397494B2

(12) United States Patent
Nagafuchi

(10) Patent No.: US 8,397,494 B2
(45) Date of Patent: Mar. 19, 2013

(54) EXHAUST DEVICE OF INTERNAL COMBUSTION ENGINE

(75) Inventor: Hiroki Nagafuchi, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 851 days.

(21) Appl. No.: 12/448,682

(22) PCT Filed: Feb. 21, 2008

(86) PCT No.: PCT/JP2008/053451

§ 371 (c)(1),
(2), (4) Date: Jun. 30, 2009

(87) PCT Pub. No.: WO2008/102917

PCT Pub. Date: Aug. 28, 2008

(65) Prior Publication Data

US 2010/0011756 A1 Jan. 21, 2010

(30) Foreign Application Priority Data

Feb. 23, 2007 (JP) ..... 2007-044192

(51) Int. Cl.
*F01N 1/00* (2006.01)
*F01N 3/00* (2006.01)

(52) U.S. Cl. ..... 60/323; 60/276

(58) Field of Classification Search ..... 60/276, 60/313, 323; 29/890.052, 890.08
See application file for complete search history.

(56) References Cited

U.S. PATENT DOCUMENTS

| | | | | |
|---|---|---|---|---|
| 4,833,882 | A * | 5/1989 | Yasuda et al. | 60/276 |
| 5,271,480 | A * | 12/1993 | Takegami | 180/309 |
| 6,082,103 | A * | 7/2000 | Sugiura et al. | 60/323 |
| 6,155,044 | A | 12/2000 | Kaiho et al. | |
| 6,230,490 | B1 * | 5/2001 | Suzuki et al. | 60/323 |
| 6,324,839 | B1 * | 12/2001 | Canini et al. | 60/323 |
| 6,325,046 | B1 | 12/2001 | Kanno | |
| 6,672,296 | B2 * | 1/2004 | Ito et al. | 123/672 |
| 6,722,126 | B2 * | 4/2004 | Kawamizu | 60/324 |
| 6,745,561 | B2 * | 6/2004 | Kim | 60/323 |
| 6,962,049 | B2 * | 11/2005 | Ashida et al. | 60/323 |

(Continued)

FOREIGN PATENT DOCUMENTS

| | | |
|---|---|---|
| JP | U-56-101445 | 8/1981 |
| JP | U-58-106531 | 7/1983 |

(Continued)

OTHER PUBLICATIONS

Ito et al., Machine Translation of JP 2000-265905 A, Sep. 26, 2000.*

(Continued)

*Primary Examiner* — Kenneth Bomberg
*Assistant Examiner* — Audrey K Bradley
(74) *Attorney, Agent, or Firm* — Oliff & Berridge, PLC

(57) ABSTRACT

An internal combustion engine wherein an exhaust pipe is connected to an exhaust outlet opening of an integral exhaust manifold-type cylinder head and a sensor having a sensing part liable to be damaged by deposition of moisture is arranged at an exhaust inlet part of the exhaust pipe. Exhaust ports of a cylinder positioned at the center are formed so that the sensing part of the sensor is not contained in the extended tubular shaped surfaces of the openings of the exhaust ports of the cylinder positioned at the center to the exhaust merging portion.

3 Claims, 3 Drawing Sheets

U.S. PATENT DOCUMENTS

| | | | | |
|---|---|---|---|---|
| 7,552,586 | B1 * | 6/2009 | White | 60/302 |
| 2002/0023436 | A1 | 2/2002 | Akiwa et al. | |
| 2004/0226291 | A1 * | 11/2004 | Diez et al. | 60/323 |
| 2005/0115231 | A1 * | 6/2005 | Ashida et al. | 60/313 |
| 2007/0084725 | A1 * | 4/2007 | Sakai et al. | 204/424 |

FOREIGN PATENT DOCUMENTS

| | | |
|---|---|---|
| JP | U-59-52119 | 4/1984 |
| JP | A-11-81999 | 3/1999 |
| JP | A-2000-130225 | 5/2000 |
| JP | A-2000-205043 | 7/2000 |
| JP | A-2000-257466 | 9/2000 |
| JP | A-2000-265905 | 9/2000 |
| JP | A-2001-3798 | 1/2001 |
| JP | A-2002-70609 | 3/2002 |

OTHER PUBLICATIONS

Partial Translation of JP-U-56-101445, translated by Irina Knizhnik, Aug. 10, 1981.*

Japanese Office Action issued in Japanese Patent Application No. 2007-044192 on Dec. 21, 2010 (with translation).

* cited by examiner

EXHAUST DEVICE OF INTERNAL COMBUSTION ENGINE

TECHNICAL FIELD

The present invention relates to an exhaust device of an internal combustion engine.

BACKGROUND ART

Known in the art is an internal combustion engine provided with a plurality of cylinders arranged on a straight line, for example, an in-line 4-cylinder internal combustion engine, in which a No. 1 cylinder and No. 4 cylinder skipping one ignition timing are connected to a first exhaust manifold, a No. 2 cylinder and No. 3 cylinder skipping one ignition timing are connected to a second exhaust manifold, an outlet of the first exhaust manifold and an outlet of the second exhaust manifold are connected to a common exhaust pipe, and an air-fuel ratio sensor is arranged in this common exhaust pipe (see Japanese Patent Publication (A) No. 2001-3798). When merging the exhaust ports of the cylinders outside of the cylinder head at a single exhaust pipe using an exhaust manifolds in this way, various methods of arranging the pipes have been adopted in the past.

However, in an internal combustion engine provided with a plurality of cylinders arranged in a straight line, exhaust ports of a pair of cylinders positioned at two ends and an exhaust port of a center cylinder positioned between the pair of cylinders being merged at an exhaust merging portion formed in a cylinder head, and an exhaust outlet opening of the exhaust manifold being formed on a cylinder head side wall positioned outside of this exhaust merging portion, that is, in a so-called integral exhaust manifold-type cylinder head having the exhaust ports of the cylinders and the exhaust manifold of these exhaust ports formed in the cylinder head, the degree of freedom for arrangement of the exhaust ports of the cylinders is extremely low and the exhaust ports of the cylinders are formed so as to extend toward the exhaust outlet opening formed at the cylinder head side wall so that the exhaust gas from the cylinders is exhausted quickly from the exhaust outlet opening.

In this regard, in such an internal combustion engine, when arranging a sensor at an exhaust inlet part of an exhaust pipe connected to the exhaust outlet opening, exhaust gas exhausted from each cylinder reaches the sensor immediately after exhaust, so it is possible to use the sensor to detect any changes in the exhaust gas ingredients with a good response. However, in this case, a problem arises if using as a sensor a sensor having a sensor part liable to be damaged by deposition of moisture. For example, when using as the sensor an air-fuel ratio sensor detecting the oxygen concentration in the exhaust gas, the sensing part of the sensor is formed from zirconia, so if moisture deposits on the sensing part and the sensing part is rapidly cooled, the problem arises that the thermal reaction will cause the sensing part to end up fracturing.

That is, right after engine start when the engine temperature is low, the moisture contained in the exhaust gas exhausted from the combustion chambers sticks on the exhaust port inner wall surfaces and condenses. The condensed moisture merges to form large sized water droplets. These water droplets are splashed by the exhaust gas exhausted from the cylinders inside the exhaust manifold along the extended tubular shaped surfaces of the opening parts of exhaust ports to the exhaust manifold. In this regard, as explained above, in an internal combustion engine provided with an integral exhaust manifold-type cylinder head, the exhaust ports of the center cylinder are directed toward the exhaust outlet opening. As a result, the sensing part of the sensor is inevitably positioned in an extended tubular shaped surface of an opening part of an exhaust port to the exhaust manifold.

Therefore, in this case, the problem arises that the large sized water droplets formed on the inner wall surfaces of the exhaust ports of the center cylinder are splashed by the exhaust gas and deposit on the sensing part of the sensor and as a result the sensing part of the sensor is damaged.

DISCLOSURE OF THE INVENTION

An object of the present invention is to provide an exhaust device of internal combustion engine designed forming the exhaust ports of the center cylinder so that water droplets are not splashed on the sensing part of the sensor when using an integral exhaust manifold-type cylinder head.

According to the present invention, there is provided an exhaust device of an internal combustion engine provided with a plurality of cylinders arranged in a straight line, exhaust ports of a pair of cylinders positioned at two ends and an exhaust port of a center cylinder positioned between the pair of cylinders being merged at an exhaust merging portion formed in a cylinder head, and an exhaust outlet opening of the exhaust merging portion being formed on a cylinder head side wall positioned outside of the exhaust merging portion, wherein a sensor having a sensing part liable to be damaged by deposition of moisture is arranged at an exhaust inlet part of an exhaust flow passage connected to said exhaust outlet opening, and the exhaust port of the center cylinder is formed so that the sensing part of the sensor is not contained in an extended tubular shaped surface of an opening part of the exhaust port of the center cylinder to the exhaust merging portion.

BEST MODE FOR CARRYING OUT THE INVENTION

Figure 1:
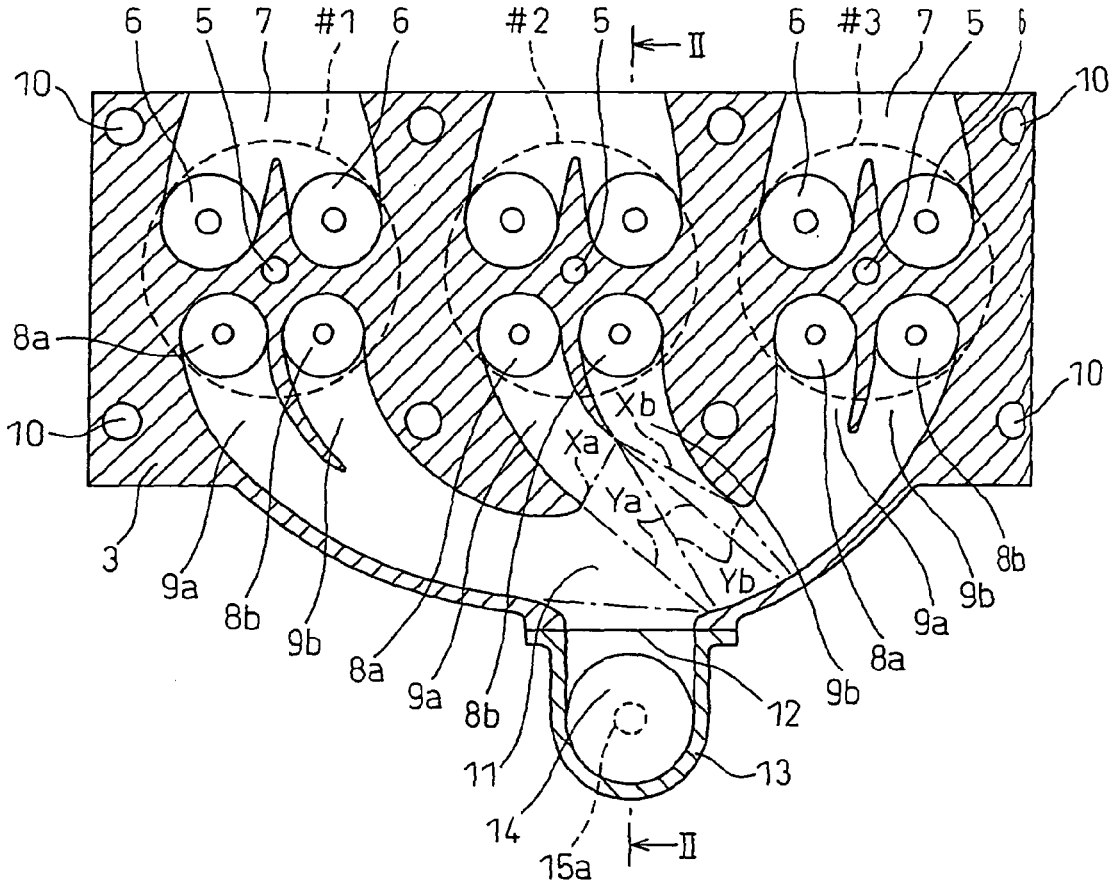
FIG. 1 is a plan cross-sectional view of a cylinder head.
Figure 2:
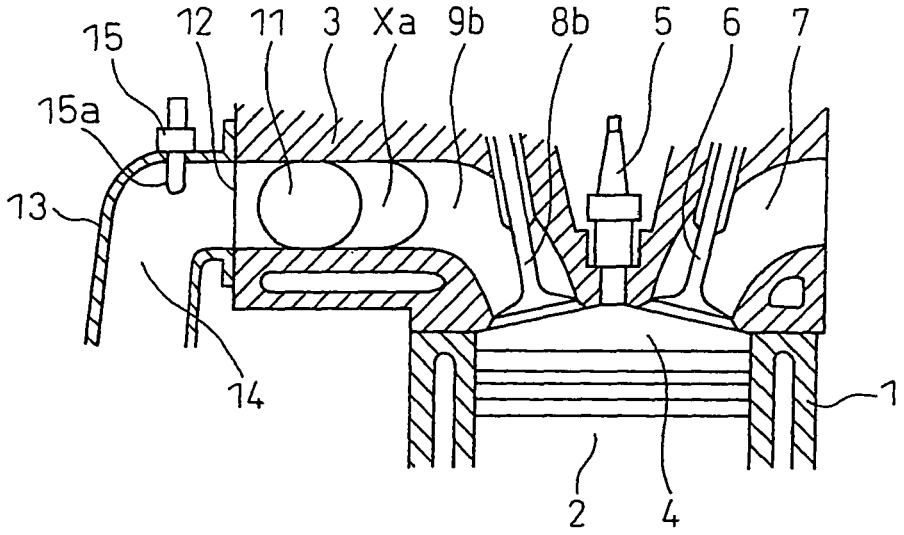
FIG. 2 is a cross-sectional view of a cylinder head taken along the line II-II of FIG. 1.

Referring to FIG. 1 and FIG. 2, 1 is a cylinder block, 2 a piston, 3 an integral exhaust manifold-type cylinder head, and 4 a combustion chamber. In FIG. 1, the broken lines respectively show the No. 1 cylinder #1, No. 2 cylinder #2, and No. 3 cylinder #3. Therefore, it is learned that the internal combustion engine shown in FIG. 1 and FIG. 2 has a plurality of cylinders arranged in a straight line. Each of the cylinders #1, #2, and #3 is provided with a spark plug 5, a pair of intake valves 6, an intake port 7, a pair of exhaust valves 8*a*, 8*b*, and a pair of exhaust ports 9*a*, 9*b*. Further, as shown by 10 at FIG. 1, the cylinder head 3 is formed with eight cylinder head bolt holes. Note that the cylinder head 3 actually has an extremely complicated shape, but in FIG. 1 and FIG. 2, the cylinder head 3 is shown simplified.

As shown in FIG. 1, the exhaust ports 9*a*, 9*b* of the pair of cylinders positioned at the two ends, that is, the No. 1 cylinder #1 and No. 3 cylinder #3, and the exhaust ports 9*a*, 9*b* of the center cylinder positioned between the pair of cylinders #1, #3, that is, the No. 2 cylinder #2, are merged at the exhaust merging portion 11 formed in the cylinder head 3 and the exhaust outlet opening 12 of the exhaust merging portion 11 is formed on the side wall of the cylinder head 3 positioned at the outside of this exhaust merging portion 11. In the embodiment shown in FIG. 1, this exhaust outlet opening 12 is formed not at the center part of the cylinder head 3 in the longitudinal direction, but somewhat toward the No. 3 cylinder #3.

In the embodiment shown in FIG. 1 and FIG. 2, this exhaust outlet opening 12 is connected to an exhaust flow passage 14 formed inside the exhaust pipe 13. At the exhaust inlet part of this exhaust flow passage 14, a sensor 15 having a sensing part 15*a* liable to be damaged by deposition of moisture is arranged. In the embodiment according to the present invention, this sensor 15 is comprised of an air-fuel ratio sensor. In the example shown in FIG. 2, a sensor 15 is arranged on the top wall surface of the exhaust flow passage 14 in substantially the same plane as the top wall surface of the exhaust merging portion 11.

In this regard, as explained above, right after engine start when the engine temperature is low, the moisture contained in the exhaust gas exhausted from the combustion chamber 2 sticks to the inner wall surfaces of the exhaust ports 9*a*, 9*b* and condenses. The condensed moisture merges to form large sized water droplets. These water droplets are carried by the exhaust gas exhausted from the cylinders #1, #2, and #3 to the exhaust outlet opening 12. On the other hand, in the integral exhaust manifold-type cylinder head 3, the part forming the manifold is formed so as not to bulge outward as much as possible, so the exhaust gas exhausted from the cylinders #1, #3 positioned at the two ends is changed in flow direction at the exhaust merging portion 11, then is exhausted from the exhaust outlet opening 12 to the inside of the exhaust pipe 13. In this case, the water droplets splashed from the inner wall surfaces of the exhaust ports 9*a*, 9*b* of these cylinders #1, #3 never strike the sensing part 15*a* of the sensor 15, so these water droplets do not particularly have to be paid much attention.

As opposed to this, the problem becomes the water droplets splashing from the inner wall surfaces of the exhaust ports 9*a*, 9*b* of the center cylinder #2. That is, if designating the opening part of the exhaust port 9*a* of the center cylinder #2 to the exhaust merging portion 11 as "Xa", the water droplets formed on inner wall surface of the exhaust port 9*a* splash along the direction of extension of the exhaust port 9*a* at the opening part Xa, that is, along the extended tubular shaped surface Ya of the opening part Xa of the exhaust port 9*a* to the exhaust merging portion 11. In the same way, if designating the opening part of the exhaust port 9*b* of the center cylinder #2 to the exhaust merging portion 11 as "Xb", the water droplets formed on inner wall surface of the exhaust port 9*b* splash along the direction of extension of the exhaust port 9*b* at the opening part Xb, that is, along the extended tubular shaped surface Yb of the opening part Xb of the exhaust port 9*b* to the exhaust merging portion 11.

In this way, if water droplets splash from the inner wall surfaces of the exhaust ports 9*a*, 9*b* of the center cylinder #2, depending on how the exhaust ports 9*a*, 9*b* were formed, the splashed water droplets are liable to flow from the exhaust outlet opening 12 to the inside of the exhaust pipe 13 and strike the sensing part 15*a* of the sensor 15. Therefore, in the present invention, to prevent the splashed water droplets from striking the sensing part 15*a* of the sensor 15, the exhaust ports 9*a*, 9*b* of the center cylinder #2 are formed so that the sensing part 15*a* of the sensor 15 is not included in the extended tubular shaped surfaces Ya, Yb of the opening parts Xa, Xb of the exhaust ports 9*a*, 9*b* of the center cylinder #2 to the exhaust merging portion 11.

Note that, to further prevent the splashed water droplets from striking the sensing part 15*a* of the sensor 15, it can be said to be preferable to prevent the splashed water droplets from being directed toward the exhaust outlet opening 12, that is, to prevent the extended tubular shaped surfaces Ya, Yb from being directed toward the exhaust outlet opening 12. Therefore, in the embodiment according to the present invention, as shown in FIG. 1, the exhaust ports 9*a*, 9*b* of the center cylinder #2 are formed so that the extended tubular shaped surfaces Ya, Yb of the opening parts Xa, Xb of the exhaust ports 9*a*, 9*b* of the center cylinder #2 to the exhaust merging portion 11 are not directed toward the exhaust outlet opening 12.

In this case, in the embodiment shown in FIG. 1, the extended tubular shaped surfaces Ya, Yb of the opening parts Xa, Xb of the exhaust ports 9*a*, 9*b* of the center cylinder #2 to the exhaust merging portion 11 are directed to the inner wall surface of the exhaust merging portion 11 adjoining the exhaust outlet opening 12. Further, in the present invention, to enable even the exhaust gas exhausted from the center cylinder #2 to flow through the sensing part 15*a* of the sensor 15, the sensing part 15*a* of the sensor 15 is arranged at the exhaust inlet part of the exhaust flow passage 14 through which the exhaust gas exhausted from the cylinders #1, #2, and #3 successively flows.

Figure 3:
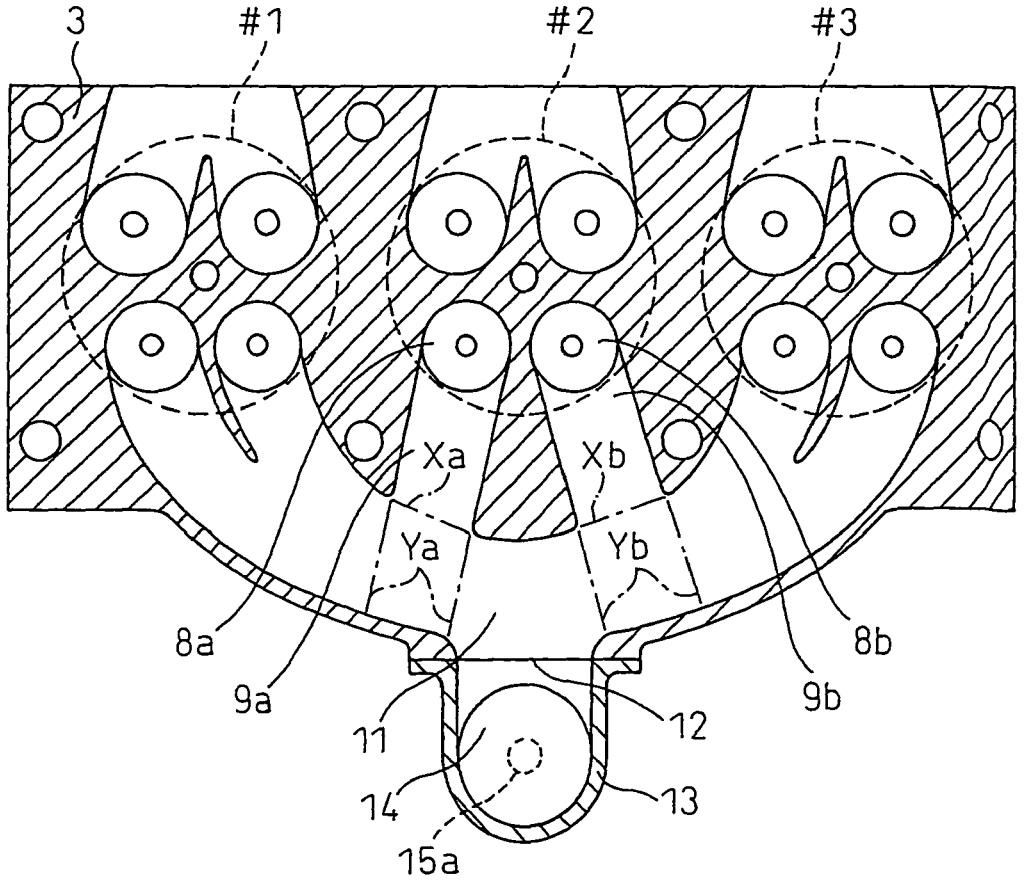
FIG. 3 is a plan cross-sectional view showing another embodiment of a cylinder head.

FIG. 3 shows another embodiment. In this embodiment, the exhaust ports 9*a*, 9*b* of the center cylinder #2 are formed so as to be separated from each other toward the two sides of the exhaust outlet opening 12 the closer to the exhaust merging portion 11. Therefore, in this embodiment as well, to prevent the splashed water droplets from striking the sensing part 15*a* of the sensor 15, the exhaust ports 9*a*, 9*b* of the center cylinder #2 are formed so that the sensing part 15*a* of the sensor 15 is not contained in the extended tubular shaped surfaces Ya, Yb of the opening parts Xa, Xb of the exhaust ports 9*a*, 9*b* of the center cylinder #2 to the exhaust merging portion 11. Further, in this embodiment as well, to prevent the splashed water droplets from further striking the sensing part 15*a* of the sensor 15, the exhaust ports 9*a*, 9*b* of the center cylinder #2 are formed so that the extended tubular shaped surfaces Ya, Yb of the opening parts Xa, Xb of the exhaust ports 9*a*, 9*b* of the center cylinder #2 to the exhaust merging portion 11 are not directed toward the exhaust outlet opening 12.

Figure 4:
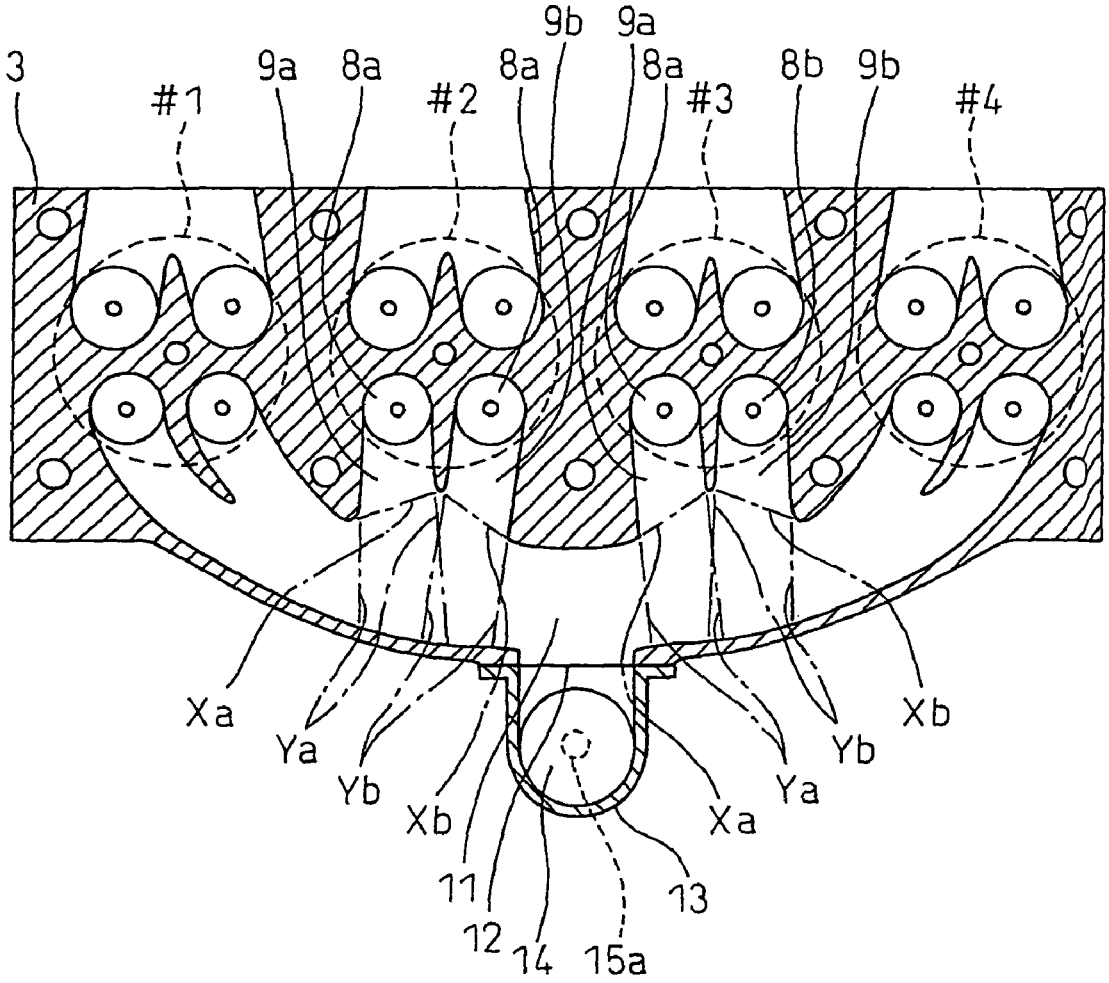
FIG. 4 is a plan cross-sectional view showing still another embodiment of a cylinder head.

FIG. 4 shows the case of application of the present invention to an in-line 4-cylinder internal combustion engine having four cylinders #1, #2, #3, and #4. As shown in FIG. 4, in this case as well, to prevent the splashed water droplets from striking the sensing part 15*a* of the sensor 15, the exhaust ports 9*a*, 9*b* of the center cylinders #2, #3 are formed so that the sensing part 15*a* of the sensor 15 is not contained in the extended tubular shaped surfaces Ya, Yb of the opening parts Xa, Xb of the exhaust ports 9*a*, 9*b* of the pair of center cylinders #2, #3 to the exhaust merging portion 11. Further, in this embodiment as well, to prevent the splashed water droplets from further striking the sensing part 15*a* of the sensor 15, the exhaust ports 9*a*, 9*b* of the center cylinders #2, #3 are formed so that the extended tubular shaped surfaces Ya, Yb of the opening parts Xa, Xb of the exhaust ports 9*a*, 9*b* of the pair of center cylinders #2, #3 to the exhaust merging portion 11 are not directed toward the exhaust outlet opening 12.

LIST OF REFERENCE NUMERALS

3 . . . cylinder head
8*a*, 8*b* . . . exhaust valve

9*a*, 9*b* . . . exhaust port
11 . . . exhaust merging portion
12 . . . exhaust outlet opening
13 . . . exhaust pipe
14 . . . exhaust flow passage
15 . . . sensor
15*a* . . . sensing part
Xa, Xb . . . opening part
Ya, Yb . . . extended tubular shaped surface

The invention claimed is:

1. An exhaust device of an internal combustion engine comprising: a plurality of cylinders arranged in a straight line, exhaust ports of a pair of cylinders positioned at two ends and a center cylinder or cylinders, each of the center cylinder or cylinders having one or more exhaust ports, positioned between the pair of cylinders being merged at an exhaust merging portion formed in a cylinder head, and an exhaust outlet opening of the exhaust merging portion being formed on a cylinder head side wall positioned outside of the exhaust merging portion, wherein a sensor having a sensing part liable to be damaged by deposition of moisture is arranged at an exhaust inlet part of an exhaust flow passage connected to said exhaust outlet opening, and water droplets formed on each inner wall of the one or more exhaust ports of each center cylinder or cylinders splash along an extended tubular shaped surface of an opening part of the one or more exhaust ports of each center cylinder or cylinders toward the exhaust merging portion, all of the one or more exhaust ports of each center cylinder or cylinders being formed so that the sensing part of the sensor is not contained in the extended tubular shaped surface of the opening part along which said water droplets splash, wherein the sensing part is disposed on a top wall surface of the exhaust flow passage such that a location of the sensing part of the sensor is aligned with a top wall planar surface of the exhaust merging portion, wherein all of the one or more exhaust ports of each center cylinder or cylinders are formed so that the extended tubular shaped surface of the opening part of the one or more exhaust ports of each center cylinder or cylinders to said exhaust merging portion are not directed toward said exhaust outlet opening.

2. An exhaust device of an internal combustion engine as claimed in claim 1, wherein the extended tubular shaped surface of the opening part of all of the one or more exhaust ports of each center cylinder or cylinders to said exhaust merging portion are directed toward an inner wall of said exhaust merging portion adjoining said exhaust outlet opening.

3. An exhaust device of an internal combustion engine as claimed in claim 1, wherein the sensing part of said sensor is arranged at the exhaust inlet part of said exhaust flow passage through which exhaust gas exhausted from said cylinders sequentially flows.

* * * * *